United States Patent [19]

Lockwood

[11] 3,930,618

[45] Jan. 6, 1976

[54] BALANCED SPRINKLER IMPACT DRIVE

[76] Inventor: George Lockwood, 2125 NE. 27th Drive, Wilton Manors, Fla.

[22] Filed: Mar. 19, 1975

[21] Appl. No.: 559,839

[52] U.S. Cl. ..... 239/230; 239/231; 239/241

[51] Int. Cl.[2] ..... B05B 3/04

[58] Field of Search ..... 239/230, 225, 231, 206, 239/241

[56] References Cited

UNITED STATES PATENTS

| | | | |
|---|---|---|---|
| 3,402,890 | 9/1968 | Heitzman | 239/230 X |
| 3,583,638 | 6/1971 | Eby et al. | 239/230 X |

*Primary Examiner*—Robert S. Ward, Jr.

[57] ABSTRACT

A sprinkler having a radially dynamically balanced intermittent drive system to provide a rotating sprinkler head generally free of all objectionable vibrations. The drive system in a preferred embodiment includes a plurality of driven surface means connected to the sprinkler head and an impact drive means rotatably positioned in the sprinkler body. The fluid driven impact drive means includes a striker carrier positioned in the sprinkler body and at least two independent striker means, preferrably balls, positioned symmetrically by the striker carrier to engage the driven surface means.

14 Claims, 6 Drawing Figures

BALANCED SPRINKLER IMPACT DRIVE

BACKGROUND OF THE INVENTION

As is perhaps well known, various types of sprinkler drives with striker means have been constructed in the past, such as the Lockwood Patent issued Aug. 31, 1971, U.S. Pat. No. 3,602,431 and the Eby et al Patent issued June 8, 1971, U.S. Pat. No. 3,583,638. In the Lockwood U.S. Pat. 3,602,431 and the Eby et al U.S. Pat. No. 3,583,638, the sprinkler must be held rigidly in the ground to prevent vibration of the assembly caused by and at the frequency of the rotation of the unbalanced striker means.

BRIEF DESCRIPTION OF THE INVENTION

The present invention relates to a new and improved balanced impact drive means that provides a plurality of rotatable striker means for engaging a plurality of driven surface means each positioned such that the drive is radially dynamically balanced. The tangential impact forces produce the necessary torque to drive the sprinkler head but radial forces are balanced. The striker means are radially movable inwardly to advance around the striker carrier after each impact. The sprinkler includes the sprinkler head that is rotatably connected to a sprinkler body. In the disclosed embodiment, which is not to limit obvious alternative embodiments, the sprinkler body includes a drive cavity. The striker means are positioned in the drive cavity. Fluid is admitted into the drive cavity to rotate the striker means. The driven surface means are connected to the sprinkler head and project into the drive cavity in the path of the striker means.

The drive system includes a striker carrier and at least two independent striker means, shown as balls. The striker means are symmetrically positioned by the striker carrier and their generally rotary path is prescribed to radially dynamically balance the carrier member and striker means as a drive system. The driven surface means and the striker means are positioned so that a plurality of impacts occur simultaneously to provide an intermittent impact drive that is free of radial vibrations and therefore this sprinkler may be placed at great heights on stand pipes without encountering vibration problems.

It is another object of this invention to provide a non-complex, radially dynamically balanced striker means in a sprinkler impact drive system.

It is another object of this invention to provide a radially dynamically balanced impact drive system having striker means movable radially after impact.

Another object of this invention is to provide the combination of a ball striker means and a ball bearing supported striker carrier with the same balls.

A further object of this invention is to provide a radially dynamically balanced impact drive system with striker means that provide synchronous engagement with the driven surfaces in order to provide a sprinkler drive means that is free of radial vibrations.

In accordance with these and other objects which will be apparent hereinafter, the instant invention will now be described with particular reference to the accompanying drawings showing one embodiment of the invention. The single embodiment is not to limit the broad teachings of this invention.

DESCRIPTION OF A PREFERRED EMBODIMENT

Figure 1:
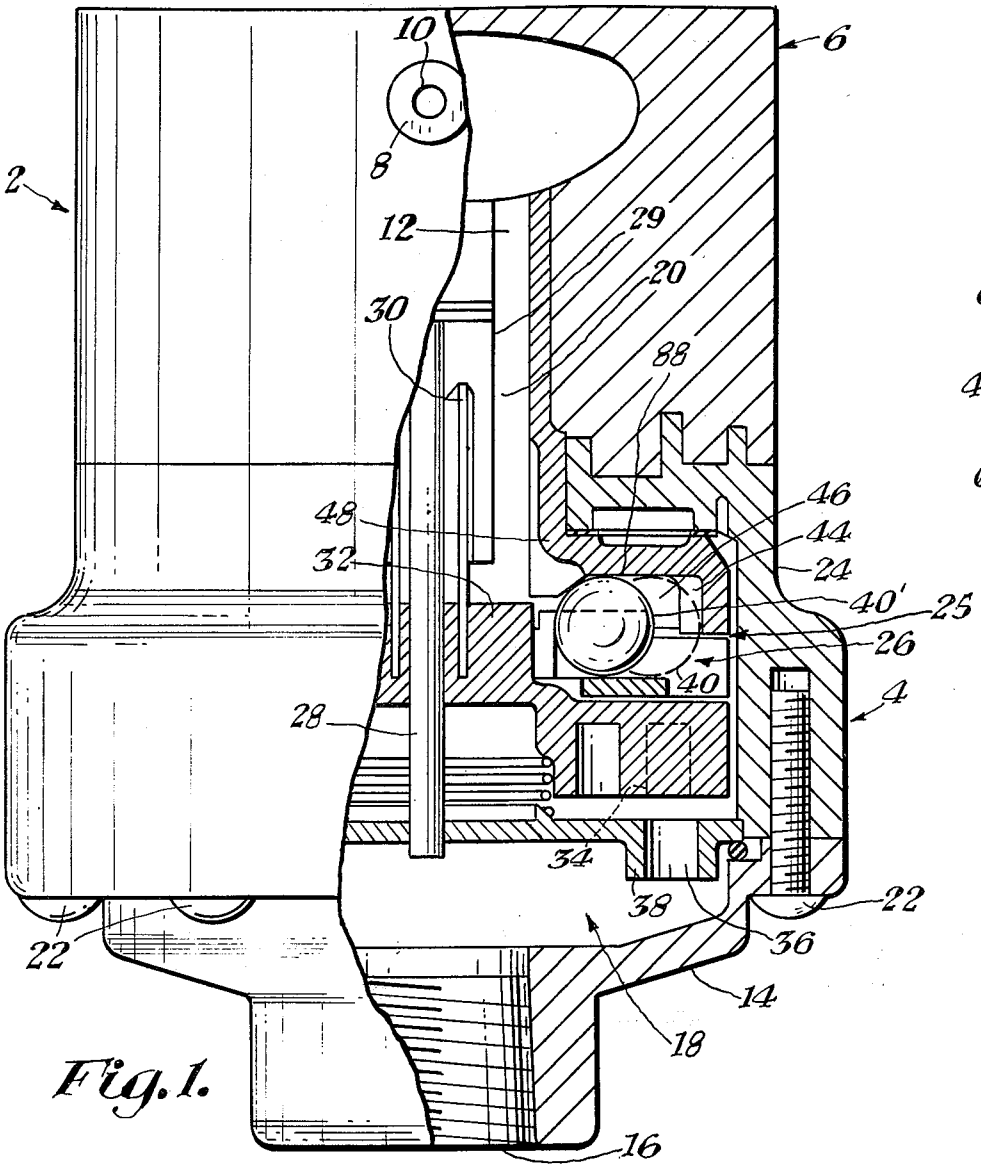
FIG. 1 is a front view of the sprinkler with a portion of the right half of the sprinkler removed to show the drive system in cross section.

Referring now to FIG. 1, and particularly to the sprinkler generally designated by numeral 2, the sprinkler 2 includes two major parts, the sprinkler body 4 and the sprinkler head 6. These members move relative to one another and, as shown in this particular embodiment, the sprinkler head 6 rotates on the sprinkler body 4. The sprinkler head, as shown in FIG. 1 includes a nozzle 8 with orifice 10 for distributing fluid from the sprinkler head. The orifice is connected to inlet 12 through a conduit. The sprinkler body 4 includes a lower inlet body member 14 with inlet 16 for receiving the fluid supply. The inlet 16 is connected to the drive chamber 25 by a conduit to pass fluid into the chamber. An outlet 20 is connected to the drive chamber 25. The outlet 20 is connected to the inlet 12 and the conduit in the sprinkler head. The fluid from the chamber passes through to outlet 20, into inlet 12 and out through orifice 10.

A plurality of screws 22 connect the lower inlet body member 14 to the intermediate body member 24. The sprinkler body 4 in the preferred embodiment provides a chamber 25 for the sprinkler drive system. Alternate embodiments of the sprinkler may include a drive system positioned outside of the sprinkler body, not shown.

Figure 4:
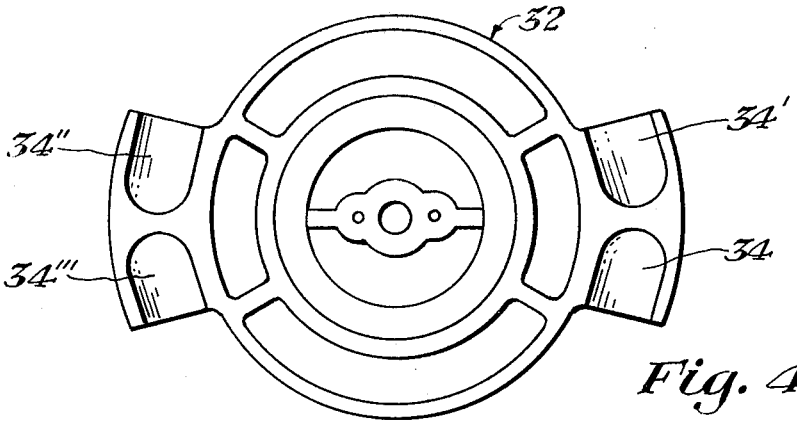
FIG. 4 is a bottom view of the reversing vane mechanism.

The sprinkler head 6 may include well known control means, not shown, for controlling the rotation and pattern of movement of the sprinkler head, such a system is disclosed in U.S. Pat. No. 3,602,431. A portion of a reversing mechanism is shown by numerals 28, 29, 30 and 32. The reverse means shaft 29 is connected to the vane control means 32 through torsion means 30 and pivot shaft 28. The vane control means 32 includes a plurality of vanes 34, 34', 34'' and 34''' as shown in FIGS. 1 and 4.

Figure 5:
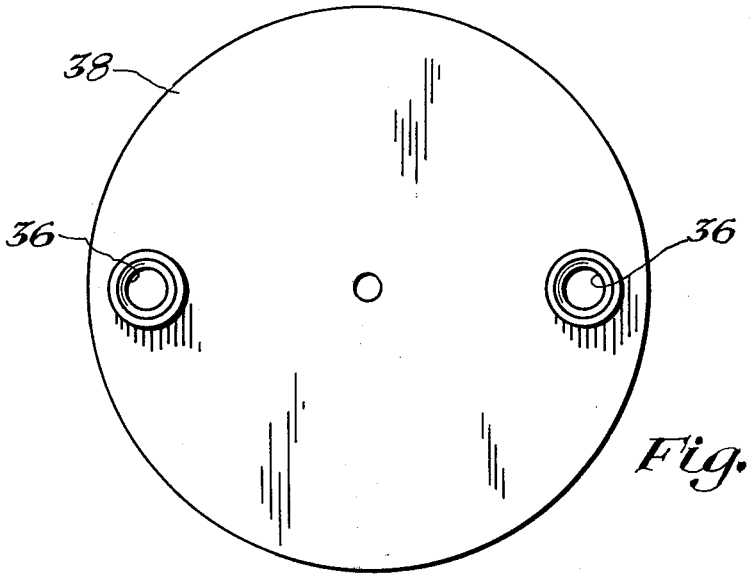
FIG. 5 is a bottom view of the control plate.

The fluid is directed up through body inlet 16 into passage 18, in the lower end of chamber 25, and then through openings 36 and 36' in control plate 38 as shown in FIGS. 1 and 5. The vane control means 32 includes a plurality of vanes 34, 34', 34'' and 34''' for providing a clockwise or counterclockwise vortex of fluid in chamber 25. The vortex of fluid provides the driving force to drive the impact drive means 26.

Figure 6:
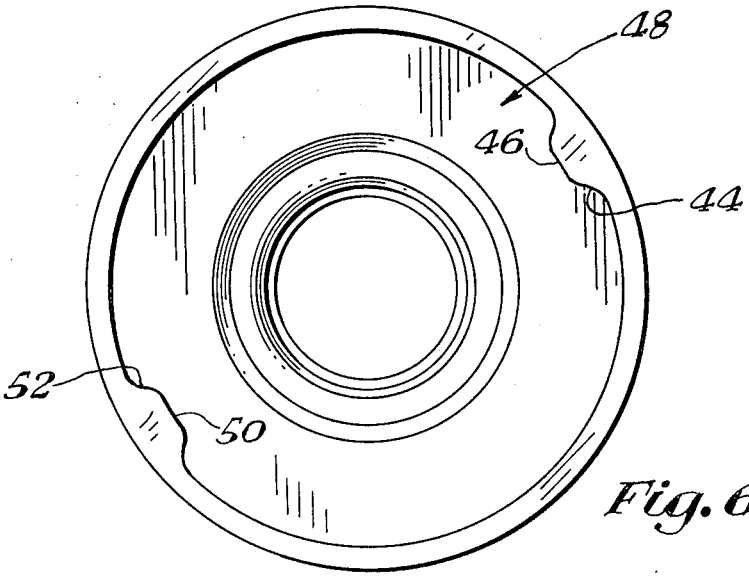
FIG. 6 is a bottom view of the driven surface means including the ball track of the sprinkler head.

Referring now to FIGS. 1, 2, 3, and 6, the sprinkler drive system includes the driven member 48 and the impact drive means 26. The impact drive means 26 rotates about the longitudinal center line or axes of the sprinkler shown in FIG. 1. The impact drive means lies generally in a plane that is perpendicular to the center line. The impact drive means 26 includes at least two striker means, shown as balls 40 and 42 and the striker carrier 54. Balls 40 and 42 are shown in an outer impact position for engagement with a driven member 48, and in particular with the driven surface 44 of anvil 46 and driven surface 52 and anvil 50. The driven member 48 is fixed in relationship to the sprinkler head. The driven member 48, as shown in FIG. 6 includes symmetrically positioned anvils 46 and 50 with driven surfaces 44, 44' and 52, 52' respectively. Surfaces 44' and 52' are engaged by the balls 40 and 42 to drive the sprinkler head in a reverse direction. The driven member 48 may include a plurality of additional anvils that are symmetrically positioned.

Figure 2:
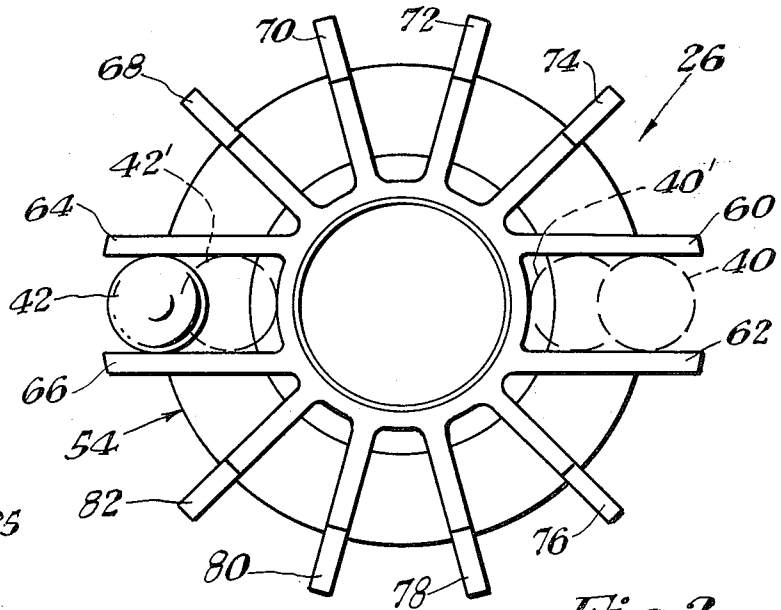
FIG. 2 is a top view of the impact drive means showing the striker carrier and illustrating the striker means as balls in both an impact position and recovery position in phantom.
Figure 3:
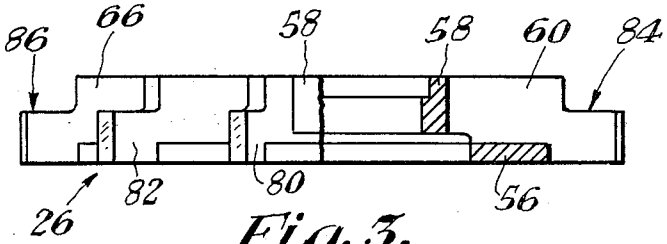
FIG. 3 is a side view partially in cross-section of the impact drive means shown in FIG. 2.

Referring now to FIGS. 2 and 3, the striker means are illustrated as balls 40 and 42 in the impact position. The balls are illustrated in phantom in a rearward position as 40' and 42'. The balls may move inward radially in order to move around the anvils after each impact.

The striker carrier 54 includes a base member 56 for supporting the ball and an inner limiting ring 58 to limit the inward movement of the ball after every impact. The striker carrier 54 includes guide members 60 and 62 for restricting circumferential movement of the striker ball means 40 and guide members 64 and 66 to restrict the circumferential movement of the ball 42. A plurality of vanes shown as 68, 70, 72, 74 76 78, 80 and 82 are positioned about the inner ring member 58. The vanes are driven by the vortex of fluid in chamber 25. The fluid force on the vanes and the balls 40 and 42 rotate the impact drive means 26. The distal ends of the vane members 68, 70, 72, 74, 76, 78, 80 and 82 and the guide members 60, 62, 64 and 66 are notched as shown at 84 and 86 in FIG. 3 in order to allow each of the vane members and guide means to pass under the anvils connected to the sprinkler head 6, as shown in FIG. 1.

It should be noted that the number of vanes and the size of the striking means may vary in accordance with the particular design. The preferred embodiment as shown in FIGS. 1, 2, 3, and 6 shows the impact drive means includes a plurality of turbine vanes that drive a ball striker means in a captive area. The balls move between an outer and inner position on the striker carrier allowing movement around the fixed anvils after each impact.

In use, as the vortex of fluid moves up through the chamber 25 the striker carrier is rotated and forced upward. The balls engage surface 88 of the driven member 48 and act as bearing means on which the striker carrier 54 rotates. As the vortex of fluid rotates the impact drive means the two balls are caused to impact against the two anvils and rotate in perfect symmetry thereby maintaining continuous dynamic balance of the system.

The instant invention has been shown and described herein in what is considered to be a practical embodiment. It is recognized, however, that departures may be made therefrom within the scope of the invention and that obvious modifications will occur to a person skilled in the art.

What is claimed is:

1. A sprinkler relatively free of radial vibrations comprising:

a sprinkler body, a sprinkler head, movably connected to said body, and a sprinkler drive system, said sprinkler body including a fluid inlet for receiving fluid supplied to said inlet and a fluid outlet connected to said inlet, said sprinkler head including a fluid inlet connected to said sprinkler body fluid outlet, and a fluid outlet connected to said sprinkler head inlet for distributing the fluid from the sprinkler, said drive system positioned in respect to the sprinkler to move said sprinkler head relative to said sprinkler body said drive system including a plurality of driven surface means and impact drive means, said impact drive means including at least two independent striker means for intermittently contacting said driven surface means to rotate said sprinkler head, and a fluid control means positioned in respect to the sprinkler to provide a fluid driving force for rotating said impact drive means.

2. A sprinkler as set forth in claim 1, wherein, said striker means are movable radially after impact.

3. A sprinkler as set forth in claim 2 wherein, said striker means are balls.

4. A sprinkler relatively free of radial vibrations comprising:

a sprinkler body, a sprinkler head movably connected to said sprinkler body, a sprinkler drive system positioned relative to said sprinkler to move said sprinkler head relative to said sprinkler body, said sprinkler body including a fluid inlet for receiving fluid supplied to the sprinkler, and a fluid outlet connected to said inlet, said sprinkler head including a fluid inlet connected to said sprinkler body outlet, and a fluid outlet connected to sprinkler head fluid inlet for distributing the supplied fluid from the sprinkler, said sprinkler drive system including a plurality of driven surface means and impact drive means, said driven surface means connected to said sprinkler head, said impact drive means positioned relative to said sprinkler, said impact drive means including a striker carrier means and at least two independent striker means movable relative to said striker carrier means, a fluid control means for providing a fluid driving force for propelling said impact drive means for intermittently contacting said driven surface means to rotate said sprinkler head.

5. A sprinkler as set forth in claim 4 wherein;

said impact drive means are symmetrically constructed to provide a radially dynamically balanced rotatable impact drive means.

6. A sprinkler as set forth in claim 4 wherein, said striker carrier means positions each said striker means to provide a radially dynamically balanced impact drive means.

7. A sprinkler as set forth in claim 4 wherein;

each said striker means are equally spaced from one another for movement along a generally circular path by said striker carrier, and each of said driven surfaces are equally spaced in said generally circular path to provide simultaneous impact of all said striker means on said driven surfaces.

8. A sprinkler as set forth in claim 4 wherein;

said impact drive means include a plurality of balls and a striker carrier.

9. A sprinkler as set forth in claim 8 wherein;

said balls move on a generally circular pathway and said striker carrier includes ball guide means to allow relative movement between said balls and said generally circular pathway and to position each of said balls for simultaneous engagement with said driven surface means.

10. A sprinkler as set forth in claim 8 wherein; said balls provide anti-friction bearing means to support said striker carrier during movement of said impact drive means.

11. A sprinkler as set forth in claim 8 wherein;

said striker carrier includes ball guide means to position said balls for movement along their impact path before, during and after each impact.

12. A sprinkler that is relatively free of all non-torsional vibrations comprising:

a sprinkler body, a sprinkler head, and a sprinkler drive system, said sprinkler body including a fluid inlet, drive chamber connected to the fluid inlet of said body and a fluid outlet connected to said drive chamber, said sprinkler head rotatably connected to said sprinkler body, said sprinkler head includes a ball track means located in said drive chamber, said sprinkler head including a fluid inlet connected to said fluid outlet of said sprinkler body, and a fluid outlet connected to said fluid inlet of said sprinkler head for distributing the fluid supplied to the sprinkler, said drive system located in said drive chamber for rotating said sprinkler head, said drive system including a plurality of driven surface means and impact drive means, said driven surface means connected to said sprinkler head along said ball track means, said impact drive means rotatable in said drive chamber, said impact drive means including at least two independent striker ball means and a striker carrier, said carrier including ball guide means for positioning said ball means, said ball means relatively movable in said ball guide means, a fluid control means connected to said sprinkler body for providing a fluid driving force for rotating said impact drive means, and said ball means symmetrically located by said ball guide means so as to simultaneously and intermittently contact at least two of the symmetrically positioned driven surface means to rotate said sprinkler head.

13. A sprinkler as set forth in claim 12 wherein;

said ball guide means includes pathways for said ball means to move around said driven surface means after each impact.

14. A sprinkler including a balanced radially movable rotating impact drive means relatively free of radial vibrations as set forth in claim 1 wherein, each of said independent striker means are movable in the same general plane.

* * * * *